US006647831B2

(12) United States Patent
Hu

(10) Patent No.: US 6,647,831 B2
(45) Date of Patent: Nov. 18, 2003

(54) ADAPTOR DEVICE FOR A WRENCH

(76) Inventor: Bobby Hu, 8F, No. 536 ~1, Ta Chin Street, Taichung (TW)

( * ) Notice: Subject to any disclaimer, the term of this patent is extended or adjusted under 35 U.S.C. 154(b) by 0 days.

(21) Appl. No.: 10/094,343

(22) Filed: Mar. 8, 2002

(65) Prior Publication Data

US 2003/0097912 A1 May 29, 2003

(30) Foreign Application Priority Data

Nov. 28, 2001 (TW) ..... 90220754 U

(51) Int. Cl.[7] ..... B25B 13/46; B25B 13/58
(52) U.S. Cl. ..... 81/60; 81/185
(58) Field of Search ..... 81/180.1, 185, 81/124.4, DIG. 11, 438, 60–63.2, 58

(56) References Cited

U.S. PATENT DOCUMENTS 959,690 A * 5/1910 Anderson ..... 81/185
1,058,795 A * 4/1913 Sayre ..... 81/62
1,478,736 A * 12/1923 Gadberry ..... 81/124.4
4,787,278 A * 11/1988 Bononi ..... 81/438
4,979,355 A * 12/1990 Ulevich ..... 81/185

* cited by examiner

*Primary Examiner*—D. S. Meislin
(74) *Attorney, Agent, or Firm*—Alan D. Kamrath; Rider Bennett, LLP.

(57) ABSTRACT

An adaptor device includes an adaptor and a retainer. The adaptor includes a first end removably mounted in a box end of a wrench and a second end releasably engaged with an object such as a tool bit. The retainer is fixed to the first end of the adaptor and includes at least two resilient retaining sections on an outer periphery thereof. A slit is defined between two resilient retaining sections that are adjacent to each other. The resilient retaining sections abut against an edge of the box end of the wrench, thereby providing an engaging force between the resilient retaining sections and the edge of the box end that is greater than an engaging force between the adaptor and the tool bit. Thus, the tool bit can be disengaged from the adaptor without causing disengagement of the adaptor from the box end of the wrench.

16 Claims, 8 Drawing Sheets

ADAPTOR DEVICE FOR A WRENCH

BACKGROUND OF THE INVENTION

1. Field of the Invention

The present invention relates to an adaptor device for a wrench. In particular, the present invention relates to an adaptor device that can be attached to a box end of a wrench, allowing the wrench to engage with a tool bit or socket and allowing easy removal of the tool bit or socket from the adaptor without causing disengagement of the adaptor from the wrench.

2. Description of the Related Art

FIG. 7 of the drawings illustrates a conventional adaptor 2 that can be attached to a box end of a wrench 1. A drive member 3 is mounted in the box end of to wrench 1 and includes an annular groove 8 in an inner periphery thereof for receiving a C-clip 4. The adaptor 2 includes an end engaged in the drive member 3 and retained in place by the C-clip 4. A receptacle 6 is defined in the other end of the adaptor 2. An annular groove 9 is defined in an inner periphery defining the receptacle 6, and a C-clip 7 is received in the annular groove 9. An end of a tool bit 5 is releasably engaged in the receptacle 6 with the C-clip 7 engaging with a retaining groove 50 in an outer periphery of the end of the tool bit 5. Thus, the wrench 1 can be used with a tool bit 5 through the use of the adaptor 2. It is noted that the retaining force provided by the C-clip 7 is greater than that provided by the C-clip 4, as the former has a smaller diameter. Thus, when removing the tool bit 5 from the adaptor 2 by means of applying force to the tool bit 5 in a direction indicated by the arrow in FIG. 8, it was found that the adaptor 2 was disengaged from the drive member 3, yet the tool bit 5 was still engaged in the receptacle 6 of the adaptor 2. As a result, the user must disengage the tool bit 5 from the adaptor 2 through another effort and then engage the adaptor 2 with the wrench 1. The procedure is troublesome and time-consuming when replacement of the tool bit 5 is required.

SUMMARY OF THE INVENTION

An object of the present invention is to provide an adaptor device that can be attached to a box end of a wrench, allowing the wrench to engage with a tool bit or socket and allowing easy removal of the tool bit or socket from the adaptor without causing disengagement of the adaptor from the wrench.

An adaptor device in accordance with the present invention comprises an adaptor and a retainer. The adaptor includes a first end removably mounted in a box end of a wrench and a second end releasably engaged with an object such as a tool bit. The retainer is fixed to the first end of the adaptor and includes at least two resilient retaining sections on an outer periphery thereof. A slit is defined between said at least two resilient retaining sections. The resilient retaining sections abut against an end of the box end of the wrench, thereby providing an engaging force between the resilient retaining sections and the end of the box end that is greater than an engaging force between the adaptor and the object.

The first end of the adaptor is inserted through the box end until the retainer is completely passed through the box end. The resilient retaining sections are compressed while passing through the box end. The resilient retaining sections resume their shapes after passing through and abut the end of the box end. Thus, the tool bit can be disengaged from the adaptor without causing disengagement of the adaptor from the box end of the wrench. Preferably, each resilient retaining section is convex in an intermediate portion thereof and extends in a direction perpendicular to a general plane of the retainer.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
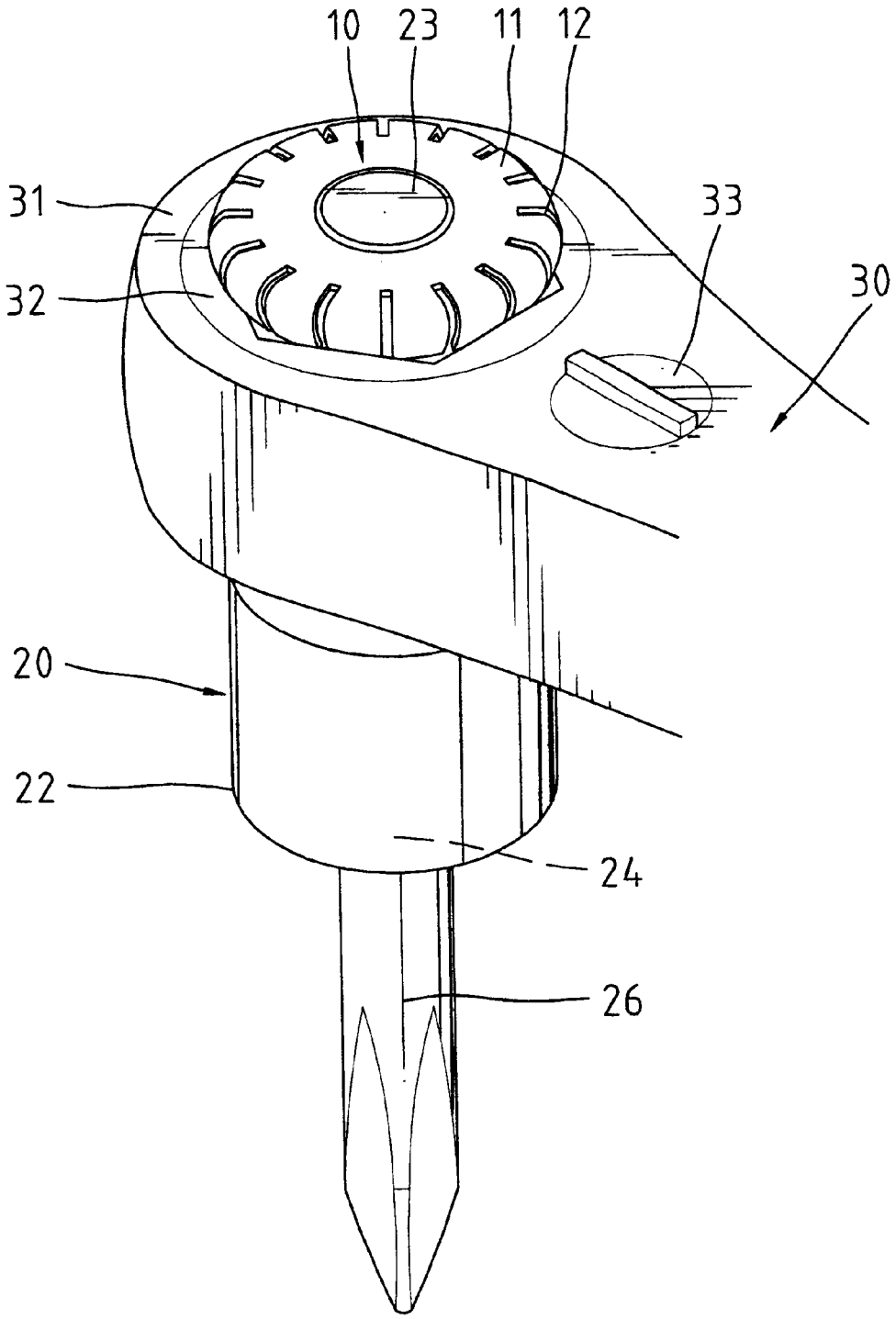
FIG. 1 is a perspective view of a wrench, a tool bit, and an adaptor device in accordance with the present invention.
Figure 2:
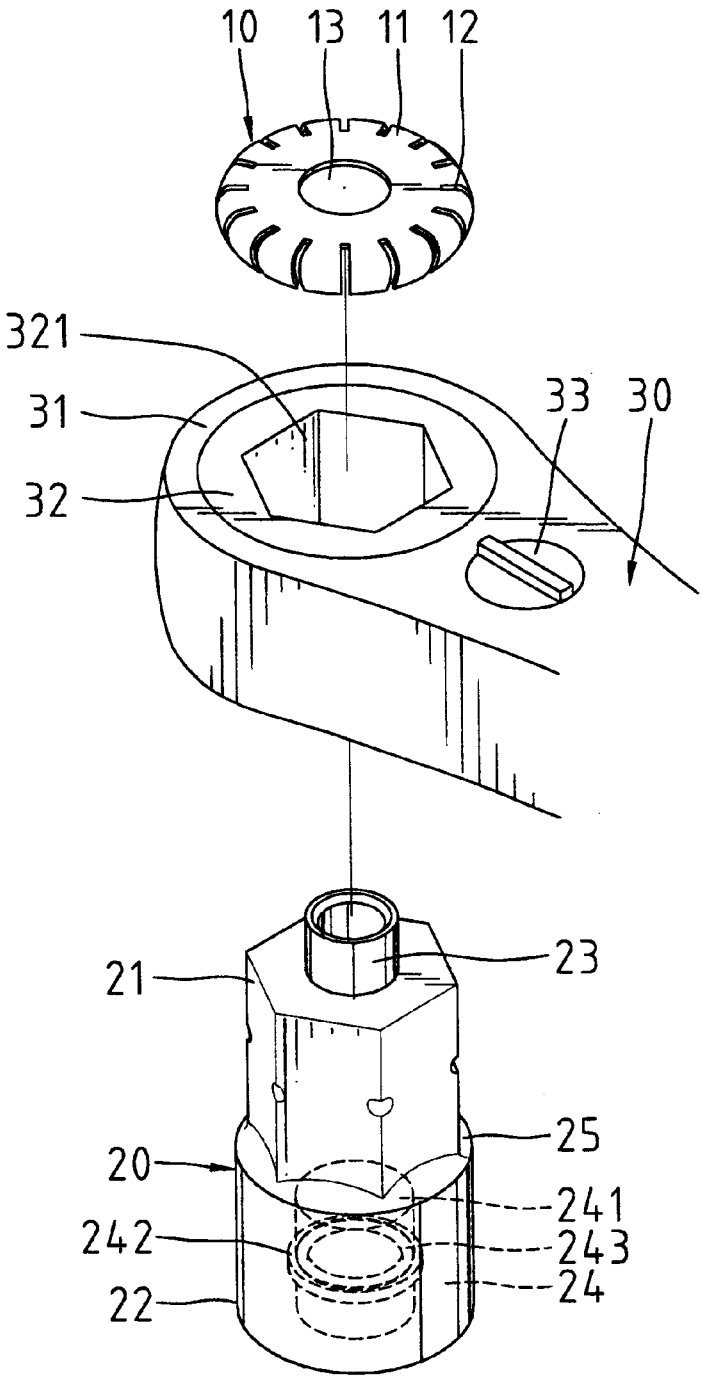
FIG. 2 is an exploded perspective view of the wrench and the adaptor device in accordance with the present invention.

Referring to FIG. 1, an adaptor device for a wrench in accordance wit the present invention generally comprises a retainer 10 and an adaptor 20 to be attached to a box end 31 of a wrench 30. The retainer 10 includes at least two resilient retaining sections on an outer periphery thereof. In this embodiment, a plurality of radially extending resilient retaining sections 11 are formed along the outer periphery of the retainer 10 with a slit 12 defined between each two retaining sections 11 that are adjacent to each other. Thus, each of the resilient retaining sections 11 has its resiliency. Each resilient retaining section 11 is preferably convex in an intermediate portion thereof and extends in a direction perpendicular to a general plane of the retainer 10. The shape of the resilient retaining sections 11 may vary according to need. Further, a central hole 13 is defined in the retainer 10.

The adaptor 20 includes a first end 21 and a second end 22. In this embodiment, an end face of the first end 21 of the adaptor 20 includes an engaging portion 23 that is extended through the central hole 13 of the retainer 10 and then riveted, thereby securely fixing the retainer 10 to the first end 21 of the adaptor 20. The second end 22 of the adaptor 20 includes a drive section 24 that may vary according to need (for engaging with a socket or a tool bit). A shoulder 25 is formed between the first end 21 and the second end 22 of the adaptor 20. A receptacle 241 is defined in the drive section 24 with an open end facing away from the first end 21 of the adaptor 20. An annular groove 242 is defined in an inner periphery defining the receptacle 241 for receiving a resilient retaining element such as a C-clip 243.

The wrench 30 includes a handle (not labeled) and a box end 31 extending from the handle. A drive member 32 is mounted in the box end 31 and includes a hole 321 for engaging with and driving a fastener. A switch member 33 is mounted to the handle for switching ratcheting directions of the wrench 30, which is conventional and therefore not described in detail.

Figure 3:
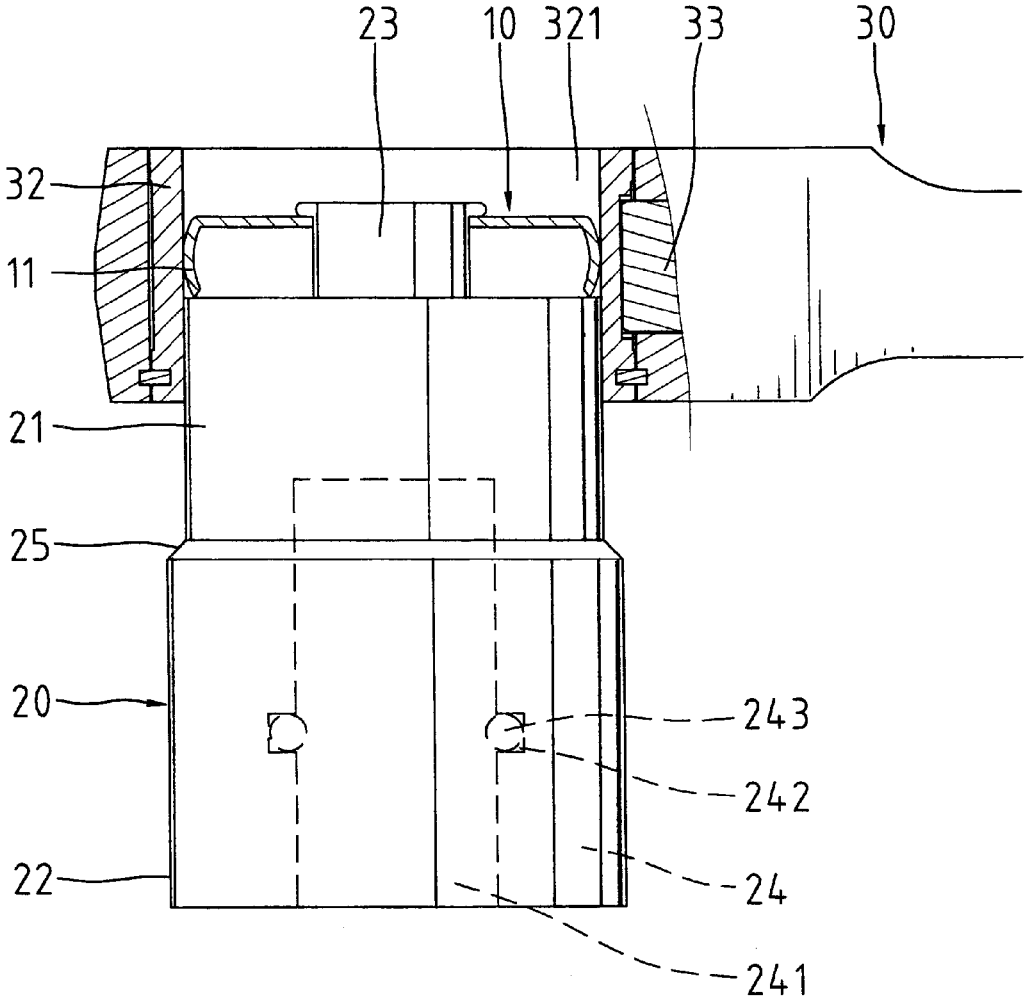
FIG. 3 is a side view, partly sectioned, of the wrench and the adaptor device in accordance with the present invention.
Figure 4:
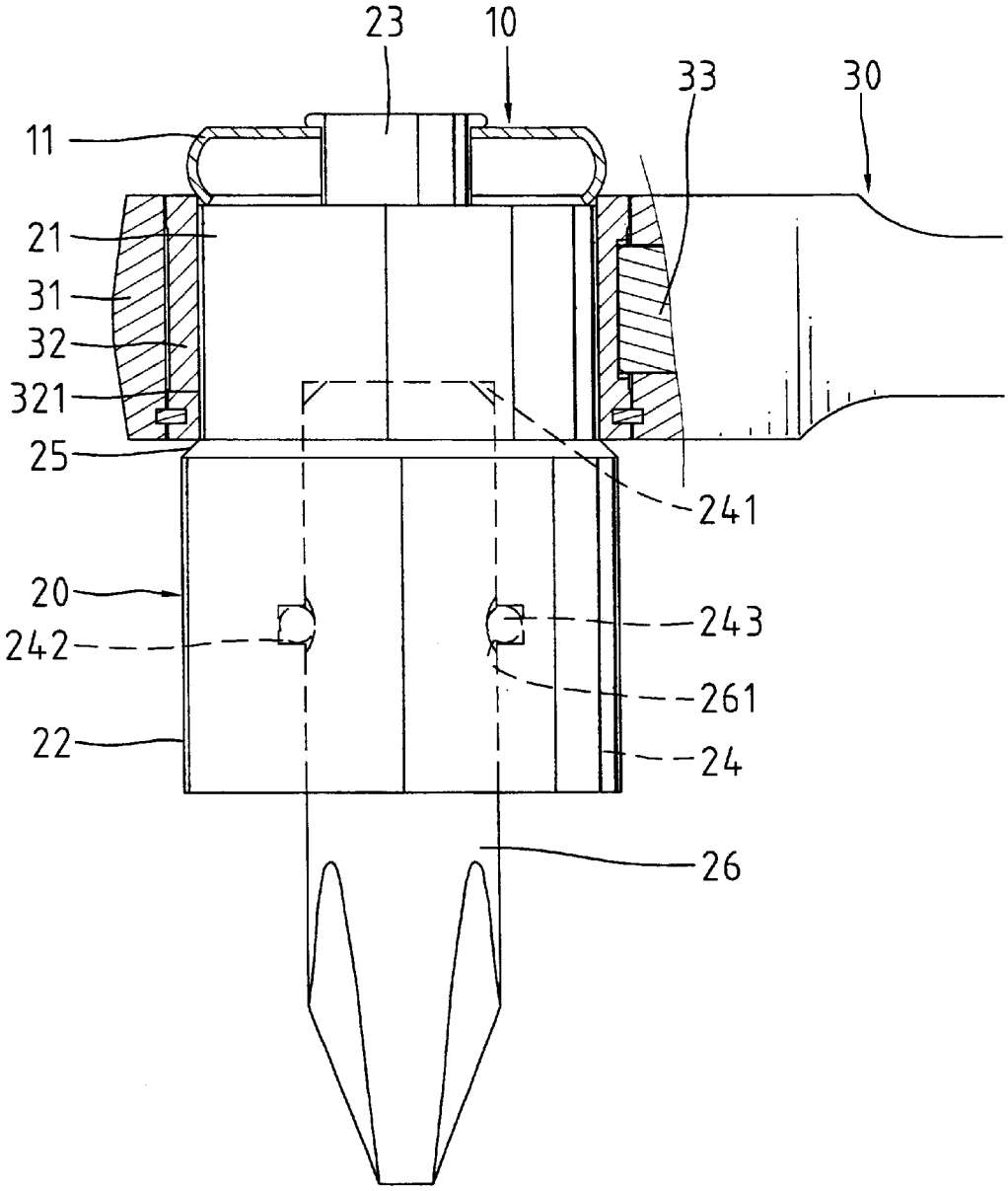
FIG. 4 is a sectional view similar to FIG. 3, wherein the tool bit is attached to the adaptor device.

In assembly, as shown in FIG. 3, the first end 21 of the adaptor 20 is inserted, from an end of the drive member 32 through the other end of the drive member 32, into the hole 321 of the drive member 32. A larger force is required to force the resilient retaining sections 11 to pass through the end of the drive member 32. As can be seen in FIG. 3, the resilient retaining sections 11 are compressed inward. Referring to FIG. 4, when the retainer 10 passes through the other end of the drive member 32, the resilient retaining sections 11 resume their shapes and thus abut against an edge of the other end of the drive member 32. It is noted that a diameter of the annularly disposed, resilient retaining sections 11 is greater than a diameter of the hole 321 of the drive member 32, it is impossible 4 disengage the adaptor 20 from the drive member 32 unless a relatively large force is applied in direction opposite to the mounting direction. The shoulder 25 abuts against a side of the drive member 32 opposite to the retainer 10 to prevent excessive movement of the adaptor 20. Then, a tool bit 26 (or a socket) can be attached to the second end 22 of the adaptor 20. The tool bit 26 includes a retaining groove 261 in an outer periphery thereof. The C-clip 243 is securely engaged in the retaining groove 261 of the tool bit 26, thereby retaining the tool bit 26 in place.

Figure 5:
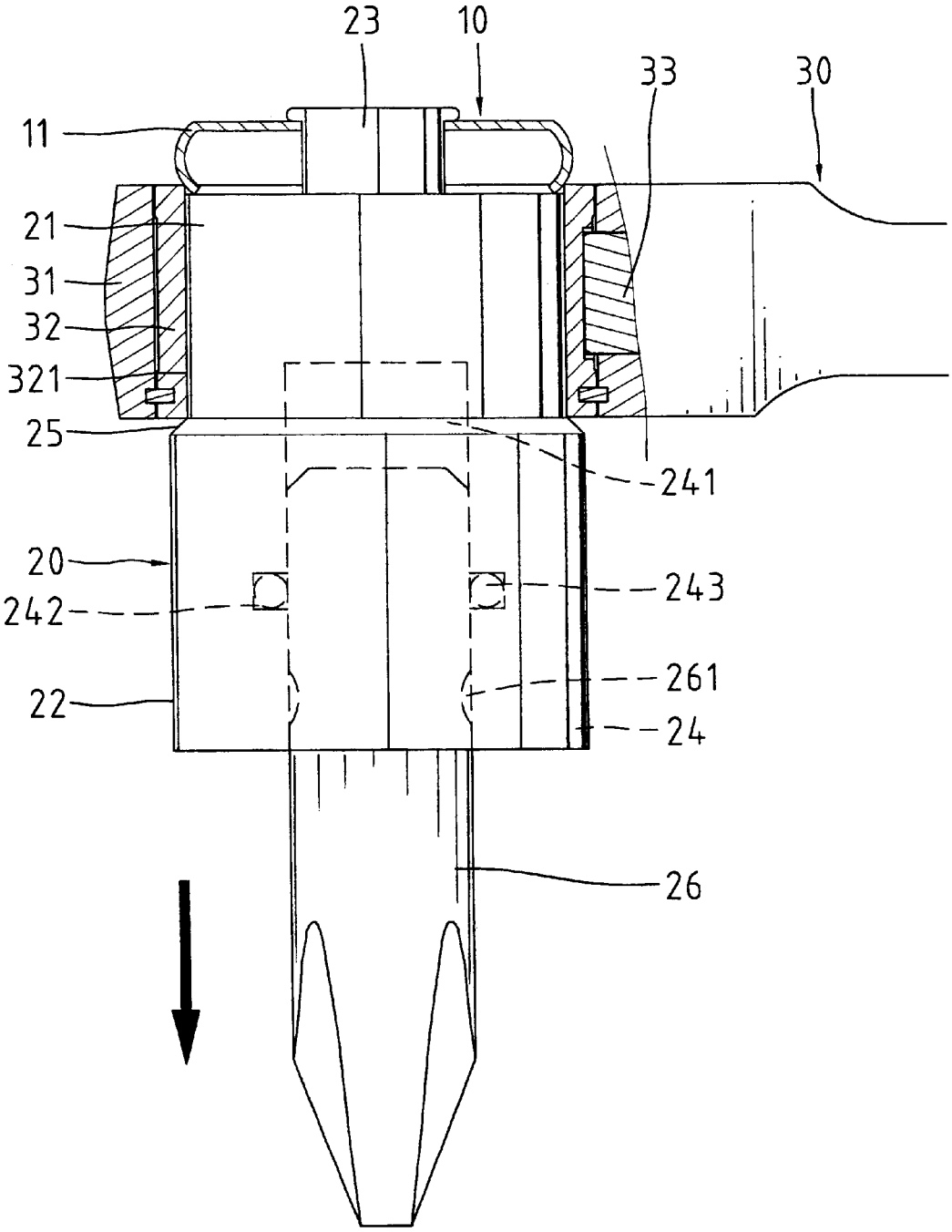
FIG. 5 is a sectional view similar to FIG. 4, illustrating removal of the tool bit from the adaptor device.

When removal of the tool bit 26 is required, the user may pull the tool bit 26 along a direction indicated by an arrow in FIG. 5, the tool bit 26 is thus disengaged from the adaptor 20 without causing disengagement of the adaptor 20 from the drive member 32. This is because the engaging force between the resilient retaining sections 11 and the other end of the drive member 32 is greater than that between the C-clip 243 and the tool bit 26. Thus, the tool bit 26 can be easily detached from the adaptor 20 for replacement. As mentioned above, the user may apply a relatively large force sufficient to overcome the engaging force between the resilient retaining sections 11 and the other end of the drive member 32 when removal of the adaptor 20 is required. The resilient retaining sections 11 are compressed for subsequently passing through the hole 321 of the drive member 32.

Figure 6:
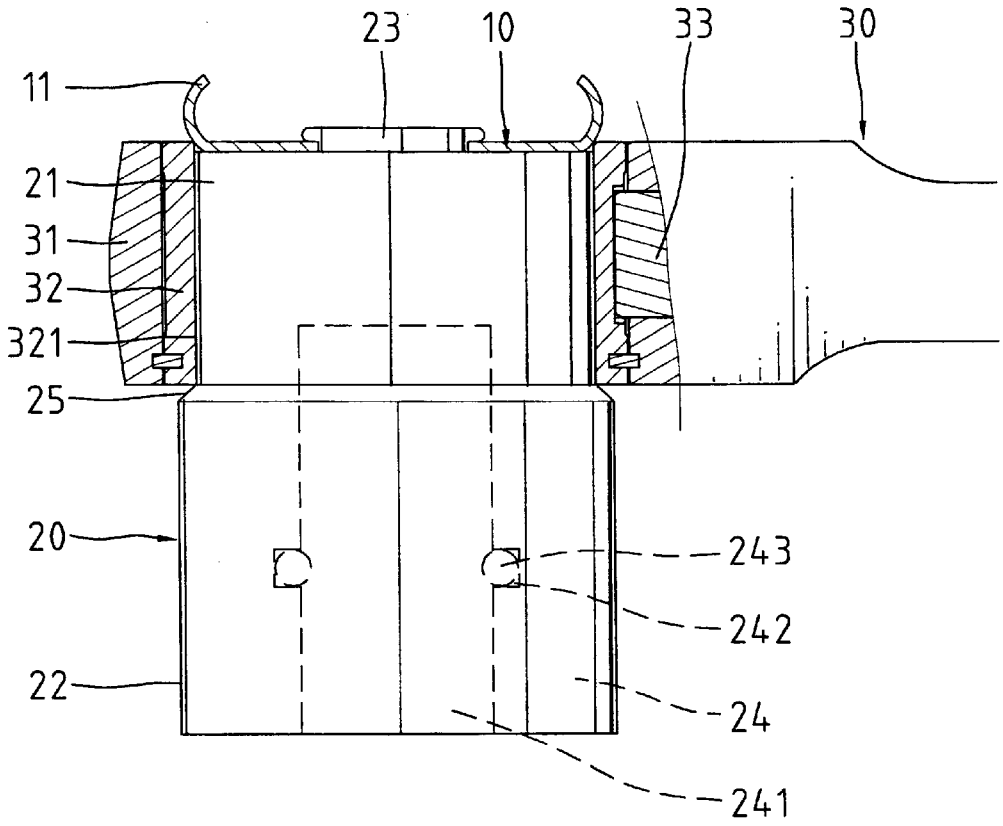
FIG. 6 is a view illustrating a wrench and a modified embodiment of the adaptor device in accordance with the present invention.
Figure 7:
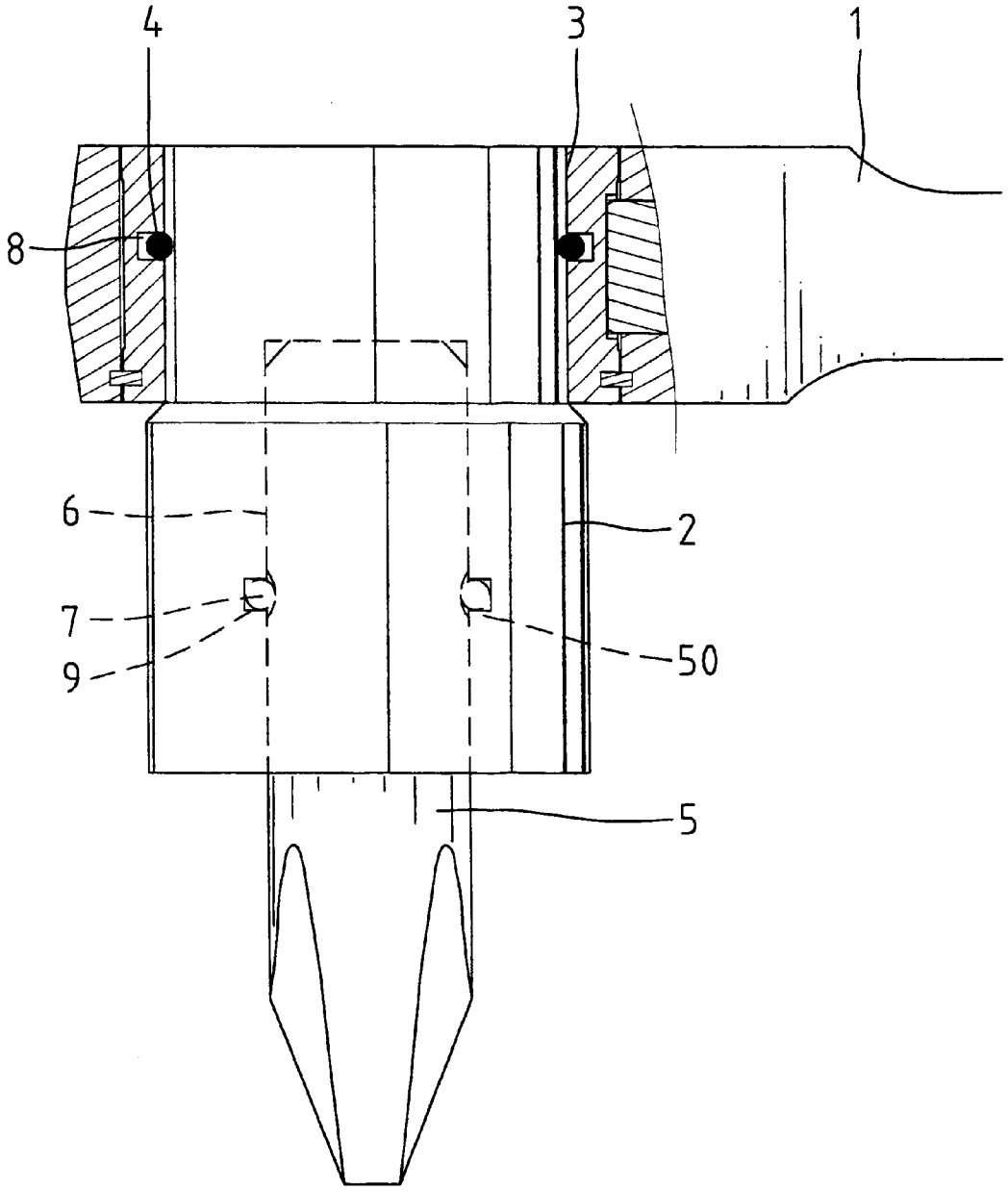
Fig. 7 PRIOR ART
FIG. 7 is a sectional view of a wrench, a tool bit, and a conventional adaptor.
Figure 8:
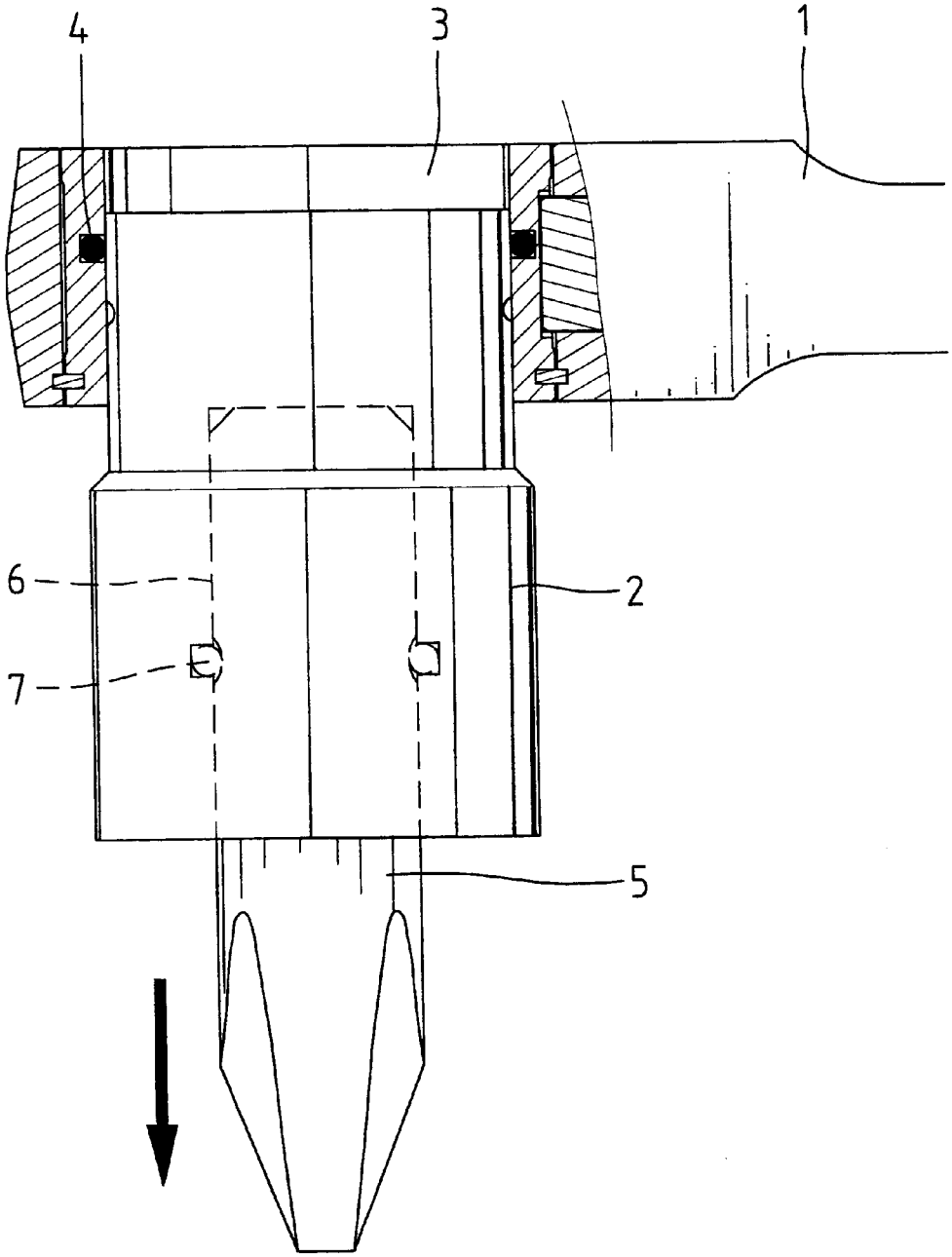
Fig. 8 PRIOR ART
FIG. 8 is a sectional view similar to FIG. 7, illustrating removal of the tool bit.

FIG. 6 illustrates a modified embodiment of the invention, wherein the retainer 10 is fixed to the engaging portion 23 of the adaptor 20 in an inverted state without affecting its function.

Although the invention has been explained in relation to its preferred embodiment, it is to be understood that many other possible modifications and variations can be made without departing from the scope of the invention as hereinafter claimed.

What is claimed is:

1. An adaptor device adapted to be removably mounted in a box end of a wrench, the adaptor device comprising:

an adaptor including a first end adapted to pass into and be removably mounted in the box end of a wrench, with the adaptor including a second end located outside of the box end of the wrench when the first end is mounted in the box end and having a configuration adapted to be releasably engaged with an object; and a retainer fixed to the first said of the adaptor, the retainer including at least two resilient retaining sections on an outer periphery thereof, a slit being defined between said at least two resilient retaining sections, said at least two resilient retaining sections having a compressed size adapted to pass through the box end of the wrench and having an uncompressed shape larger than the box end of the wrench and adapted to abut against an edge of the box end of the wrench, thereby providing an engaging force between said at least two resilient retaining sections and the edge of the box end that is greater than an engaging force between the second end of the adaptor and the object.

2. The adaptor device as claimed in claim 1, wherein the retainer is riveted to an end face of the first end of the adaptor.

3. The adaptor device as claimed in claim 2, wherein the retainer includes a central hole, the end face of the first end of the adaptor includes an engaging member that is passed through the central hole of the retainer and then riveted.

4. The adaptor device as claimed in claim 1, wherein the second end of the adaptor includes a shoulder of cross sectional size larger than the first end of the adapter and adapted to abut with an opposing edge of the box end of the wrench opposite to the edge abutted by the retainer.

5. The adaptor device as claimed in claim 1, wherein the object is a tool bit.

6. An adaptor device adapted to be removably mounted in a box end of a wrench, the adaptor device comprising:

an adaptor including a first end adapted to pass into and be removably mounted in the box end of the wrench, with the adaptor including a second end located outside of the box end of the wrench when the first end is mounted in the box end and having a configuration adapted to be releasably engaged with an object; and a retainer fixed to the first end of the adaptor, the retainer including a plurality of radially extending resilient retaining sections on an outer periphery thereof, a slit being defined between two of said resilient retaining sections that are adjacent to each other, said resilient retaining sections having a compressed size adapted to pass through the box end of the wrench and having an uncompressed shape larger than the box end of the wrench and adapted to abut against an edge of the box end of the wrench, thereby providing an engaging force between the resilient retaining sections and the edge of the box end that is greater than an engaging force between the second end of the adaptor and the object.

7. The adaptor device as claimed in claim 6, wherein the retainer is riveted to an end face of the first end of the adaptor.

8. The adaptor device as claimed in claim 7, wherein the retainer includes a central hole, the end face of the first end of the adaptor includes an engaging member that is passed through the central hole of the retainer and then riveted.

9. The adaptor device as claimed in claim 6, wherein the second end of the adaptor includes a shoulder of a cross sectional size larger than the first end of the adaptor and adapted to abut with an opposing edge of the box end of the wrench opposite to the edge abutted by the retainer.

10. The adaptor device as claimed in claim 6, wherein the object is a tool bit.

11. A device comprising:

a wrench having a box end;

an adaptor including a first end removably received and mounted in the box end of the wrench in a nonrotatable manner, with the adaptor including a second end located outside of the box end of the wrench when the first end is mounted in the box end and having a configuration adapted to be releasably engaged with an object; and a retainer fixed to the first end of the adaptor, the retainer including at least two resilient retaining sections on an outer periphery thereof, a slit being defined between said at least two resilient retaining sections, said at least two resilient retaining sections having a compressed size passable through the box end of the wrench in a mounting direction and having an uncompressed size larger than the box end of the wrench and abuttable against an edge of the box end of the wrench, thereby providing an engaging force between the resilient retaining sections and the edge of the box end when a force applied opposite to the mounting direction that is greater than an engaging force between flap second end of the adaptor and the object applied for releasing the object from the adaptor opposite to the mounting direction.

12. The device as claimed in claim 11, wherein the retainer is riveted to an end face of the first end of the adaptor.

13. The device as claimed in claim 12, wherein the retainer includes a central hole, the end face of the first end of the adaptor includes an engaging member that is passed through the central hole of the retainer and then riveted.

14. The device as claimed in claim 11, wherein the second end of the adaptor includes a shoulder of a cross sectional size larger than the first end of the adaptor and that abuts an opposing edge of the box end of the wrench opposite to the edge abutted by the retainer.

15. The device as claimed in claim 11, wherein the first end of the adaptor is inserted through the box end with the retainer fixed to the first end of the adaptor and until the retainer is completely passed through the box end, said at least two resilient retaining sections being compressed to the compressed size while passing through the box end, said at least two resilient retaining section resuming their uncompressed size after passing through and abutting the edge of the box end.

16. The device as claimed in claim 11, wherein the object is a tool bit.

* * * * *